US011229093B2

(12) United States Patent
Imai et al.

(10) Patent No.: US 11,229,093 B2
(45) Date of Patent: Jan. 18, 2022

(54) COOKER

(71) Applicant: Panasonic Intellectual Property Management Co., Ltd., Osaka (JP)

(72) Inventors: Hirohisa Imai, Shiga (JP); Gantetsu Matsui, Kyoto (JP); Hirokazu Kusuura, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 248 days.

(21) Appl. No.: 16/089,211

(22) PCT Filed: Mar. 23, 2017

(86) PCT No.: PCT/JP2017/011667
§ 371 (c)(1),
(2) Date: Sep. 27, 2018

(87) PCT Pub. No.: WO2017/175591
PCT Pub. Date: Oct. 12, 2017

(65) Prior Publication Data

US 2019/0261469 A1 Aug. 22, 2019

(30) Foreign Application Priority Data

Apr. 7, 2016 (JP) ..... JP2016-076981

(51) Int. Cl.
*H05B 6/64* (2006.01)
*H05B 6/68* (2006.01)
(Continued)

(52) U.S. Cl.
CPC ..... *H05B 6/6441* (2013.01); *F24C 7/02* (2013.01); *F24C 7/04* (2013.01); *H05B 6/687* (2013.01)

(58) Field of Classification Search
CPC .... H05B 6/6441; H05B 6/687; H05B 6/6447; H05B 6/6435; F24C 7/02; F24C 7/04
(Continued)

(56) References Cited

U.S. PATENT DOCUMENTS 5,504,311 A 4/1996 DuBuis et al.
5,724,244 A 3/1998 Yabuki
(Continued)

FOREIGN PATENT DOCUMENTS

JP 59-133683 A 8/1984
JP 6-508910 10/1994
(Continued)

OTHER PUBLICATIONS

International Search Report of PCT application No. PCT/JP2017/011667 dated Jun. 13, 2017.

*Primary Examiner* — Tu B Hoang
*Assistant Examiner* — Alba T Rosario-Aponte
(74) *Attorney, Agent, or Firm* — McDermott Will and Emery LLP

(57) ABSTRACT

A cooker includes a heating chamber configured to accommodate an object to be heated, a heater configured to heat the object to be heated accommodated in the heating chamber, heating controller (14) configured to control the heater for heating, an image capturing unit configured to capture an image inside the heating chamber, and mark detector (28) configured to detect a specific mark from the image captured by the image capturing unit. Heating controller (14) disallows or allows heating by the heater, based on a result of detection by mark detector (28).

3 Claims, 4 Drawing Sheets

(51) Int. Cl.
*F24C 7/04* (2021.01)
*F24C 7/02* (2006.01)

(58) Field of Classification Search
USPC ..... 219/702, 678, 714
See application file for complete search history.

(56) References Cited

U.S. PATENT DOCUMENTS

| | | | | |
|---|---|---|---|---|
| 10,616,962 | B2 * | 4/2020 | Imai | F24C 7/08 |
| 2013/0306627 | A1 * | 11/2013 | Libman | H05B 6/705 219/705 |
| 2013/0334214 | A1 * | 12/2013 | Yogev | H05B 6/6458 219/702 |
| 2016/0192446 | A1 * | 6/2016 | Seddik | H05B 6/6482 219/705 |

FOREIGN PATENT DOCUMENTS

| | | | |
|---|---|---|---|
| JP | 8-291914 | A | 11/1996 |
| JP | 2001-324146 | | 11/2001 |
| JP | 2001-349546 | | 12/2001 |
| JP | 2006-132793 | A | 5/2006 |

* cited by examiner

COOKER

CROSS-REFERENCE TO RELATED APPLICATIONS

This application is a U.S. national stage application of the PCT International Application No. PCT/JP2017/011667 filed on Mar. 23, 2017, which claims the benefit of foreign priority of Japanese patent application No. 2016-076981 filed on Apr. 7, 2016, the contents all of which are incorporated herein by reference.

TECHNICAL FIELD

The present disclosure relates to a cooker configured to heat a food product.

BACKGROUND ART

A microwave oven is a typical cooker, and is convenient because a food product in a container can be heated without using either a pot or a pan. For example, in a shop selling bento lunch boxes or daily dishes in containers, a service clerk may heat a food product being sold with a microwave oven.

Such a heating service will be described. An ordinary container of a bento lunch box or a daily dish is indicated with an appropriate heating period for heating with a microwave oven. A service clerk of a shop refers to the indication, sets the heating period with the microwave oven, and heats the food product. An operation section of the microwave oven is provided with a numerical keypad, for example. The service clerk manually sets the heating period (minute(s), second(s)) with the microwave oven.

Another microwave oven is provided with a plurality of operation buttons. The operation buttons are respectively allocated with different heating periods. In this case, a service clerk of a shop selects a button corresponding to a food product to be heated, heats the food product under a heating control appropriate for the food product, and provides the food product to a customer.

With the former configuration, setting a heating period (minute(s), second(s)) with the numerical keypad may increase cumbersome operations in number. With the latter configuration, i.e., with the plurality of operation buttons respectively allocated with the different heating periods, a service clerk may face difficulty in remembering correspondence relationships between the buttons and the heating periods as kinds of food products increase.

Such a method described below has been proposed for reduction of cumbersome and erroneous operations. In the method, a microwave oven is stored with a content of heating control beforehand per product. A service clerk of a shop uses a bar-code reader to read information (code information) represented by a bar-code applied onto a product. In the microwave oven, the content of heating control corresponding to the product is called from the code information for appropriate heating.

Such a method without using a bar-code reader, described below, has also been proposed. In the method, a microwave oven is equipped with a camera configured to capture an image inside a chamber of the microwave oven. When the camera captures an image of a product accommodated in the chamber, a bar-code is extracted and read from the image. A content of heating control corresponding to the product is called from code information being read for appropriate heating. With heating control information directly applied onto a product as code information, it is not necessary that the heating control information corresponding to the product be called from code information, or stored beforehand per product in a microwave oven.

According to the method, a service clerk can provide heating services with reduced burdens and errors (see PTL 1 for example).

CITATION LIST

Patent Literature

PTL 1: Unexamined Japanese Patent Publication No. 2001-349546

SUMMARY OF THE INVENTION

The present disclosure has an object to allow heating of only certain products having undergone tests, for example, and thus having heating control information. The present disclosure has another object to disallow heating of products inappropriate for heating with a microwave oven.

A cooker according to the present disclosure includes a heating chamber configured to accommodate an object to be heated, a heater configured to heat the object to be heated accommodated in the heating chamber, a heating controller configured to control the heater for heating, an image capturing unit configured to capture an image inside the heating chamber, and a mark detector configured to detect a specific mark from the image captured by the image capturing unit. The heating controller disallows or allows heating by the heater, based on a result of detection by the mark detector.

With the configuration, the image capturing unit captures an image inside the heating chamber accommodating the object to be heated. The mark detector detects a specific mark from the image captured by the image capturing unit. The heating controller configured to control the heater for heating disallows or allows heating based on a result of detection by the mark detector. Therefore, by applying a specific mark allowing heating onto only a certain product having undergone tests, for example, and by applying a mark disallowing heating onto an accompanied product inappropriate for heating with a microwave oven, heating is allowed for only the certain product, preventing the accompanied product inappropriate for heating with a microwave oven being left behind in the certain product from being heated.

With the present disclosure, by applying a specific mark allowing heating onto only certain products having undergone tests, for example, heating can be allowed for only the certain products. By applying a mark disallowing heating onto accompanied products inappropriate for heating with a microwave oven, the accompanied products inappropriate for heating with a microwave oven can be prevented from being heated.

DESCRIPTION OF EMBODIMENT

Prior to describing an exemplary embodiment of the present disclosure, problems found in a conventional microwave oven will be now briefly described herein.

To identify a product by reading a barcode applied onto the product, and to call a content of heating control for the product, it is required that a correspondence relationship between the product and a heating period be registered beforehand into a microwave oven. However, a shop handles a great number of products including bento lunch boxes and daily dishes to be heated with a microwave oven. The products may often be replaced with new products weekly or daily. It is required that correspondence relationships between the new products and heating periods be frequently registered.

On the other hand, when heating control information is directly applied onto a product as code information, the code information would be likely to be read, and accordingly the product would be likely to be heated, regardless of a kind of the product. In other words, not only products that are developed and tested by a shop as own products, and that the shop is responsible for heating control information, but also other company's products that the shop is not responsible for heating control information, may be heated.

Further, a product, such as a bento lunch box or a daily dish, may accompany a seasoning contained in a bag. It is recommended that, before the product is heated with a microwave oven, the seasoning be removed from the product. However, under an automated operation of a microwave oven, a product would be likely to be heated together with an accompanied product inappropriate for heating with a microwave oven, such as the seasoning, left behind in the product.

An exemplary embodiment will be described herein in detail with reference to the drawings appropriately. However, detailed description more than necessary may be omitted. For example, in some cases, detailed description of already well-known items and repeated description with respect to substantially the same configuration will be omitted.

These omissions are made to avoid unnecessary redundancy of the following description, and to facilitate the understanding of those skilled in the art.

Note that the attached drawings and the following description are provided for those skilled in the art to fully understand the present disclosure, and are not intended to limit the subject matter as described in the appended claims.

First Exemplary Embodiment

Figure 1:
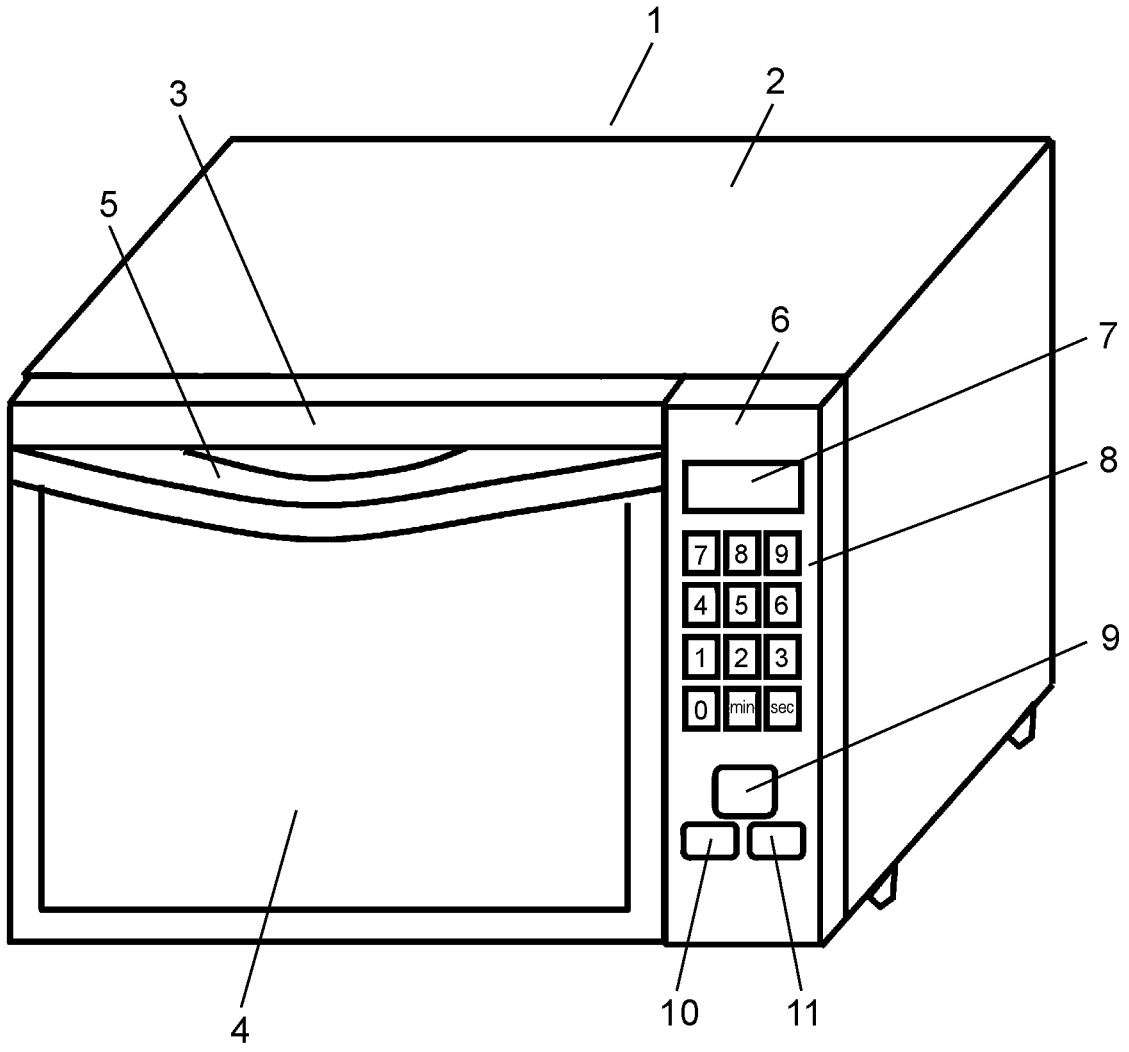
FIG. 1 is an external perspective view of a microwave oven representing an example of a cooker according to a first exemplary embodiment of the present disclosure.

FIG. 1 is an external perspective view of microwave oven 1 representing an example of a cooker according to a first exemplary embodiment of the present disclosure. As illustrated in FIG. 1, in microwave oven 1, housing 2 for accommodating a food product is provided with door 3 used to load and unload the food product. Door 3 is provided with transparent glass window 4 allowing inside housing 2 to be seen externally, handle 5 used to open and close door 3, and operation display 6.

Operation display 6 includes liquid crystal display 7, time setting button group 8, heating start button 9, cancel button 10, and stop button 11. As will be described later, microwave oven 1 allows an image capturing unit to capture an image of a product to be heated (object to be heated), and reads a heating period indicated on the product. Microwave oven 1 heats the product for the heating period being read.

Liquid crystal display 7 displays the heating period being read, as well as displays a notification text. To heat a product that has not been read for a heating period or that is not indicated with a heating period, microwave oven 1 is provided with time setting button group 8. A user can use numerical buttons, a "Minute(s)" button, and a "Second(s)" button to set a heating period. In this case, liquid crystal display 7 displays the heating period being set.

Heating start button 9 is a button to be pressed by the user having confirmed the heating period displayed on liquid crystal display 7 to start heating. Cancel button 10 is a button to be pressed by the user having pressed heating start button 9 and having started the heating to cancel the heating during the heating, or to cancel the heating period being set and displayed on liquid crystal display 7. Stop button 11 is a button to be pressed by the user to temporarily stop the heat during the heating. When the heating is temporarily stopped, the user can press again heating start button 9 to restart the heating.

Liquid crystal display 7 is also a notification unit of microwave oven 1 according to the first exemplary embodiment.

Figure 2:
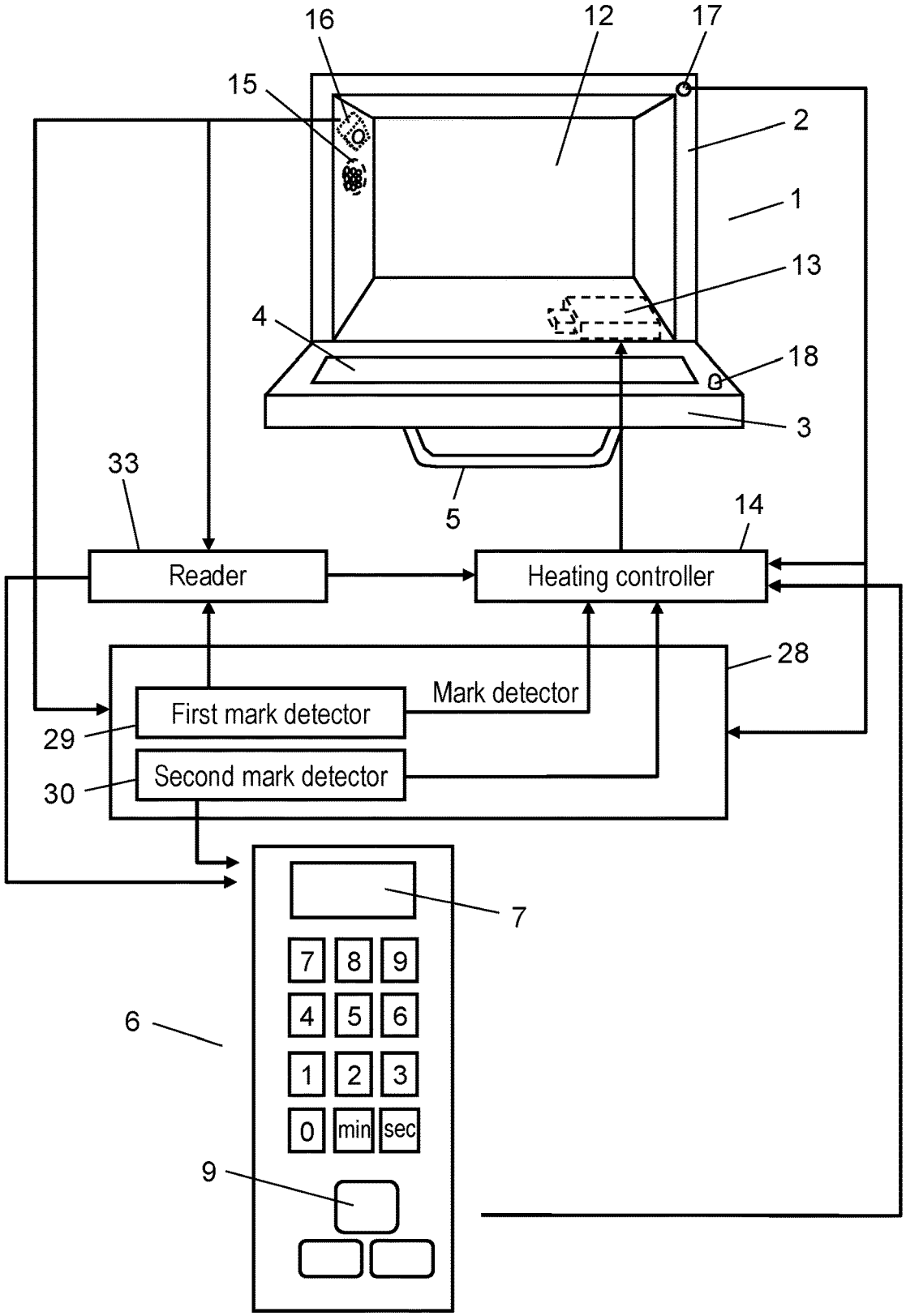
FIG. 2 is a schematic block diagram of the microwave oven according to the first exemplary embodiment of the present disclosure.

FIG. 2 is a schematic block diagram of microwave oven 1 according to the first exemplary embodiment of the present disclosure.

Microwave oven 1 can use high frequency to heat a food product, for example. Microwave oven 1 includes magnetron 13 inside heating chamber 12 configured to accommodate an object to be heated such as a food product. Magnetron 13 is a heater configured to output high frequency. Magnetron 13 supplies high frequency to heating chamber 12 to heat the object to be heated. Magnetron 13 is controlled by heating controller 14.

Microwave oven 1 includes light 15 and camera 16. Camera 16 represents the image capturing unit. Camera 16 is configured to capture an image inside heating chamber 12. Camera 16 and light 15 are disposed on an identical side face. Camera 16 can thus capture an image inside heating chamber 12 without being backlit. Housing 2 is provided with door switch 17 configured to detect whether door 3 is open or closed. Door 3 is provided with projection 18 configured to push door switch 17.

Heating chamber 12 accommodates a product (object to be heated), such as a bento lunch box, an onigiri rice ball, or a daily dish. Such a product is applied with, as product's heating control information, first sticker 19, as illustrated in FIG. 3, indicating heating power and a heating period.

Figure 3:
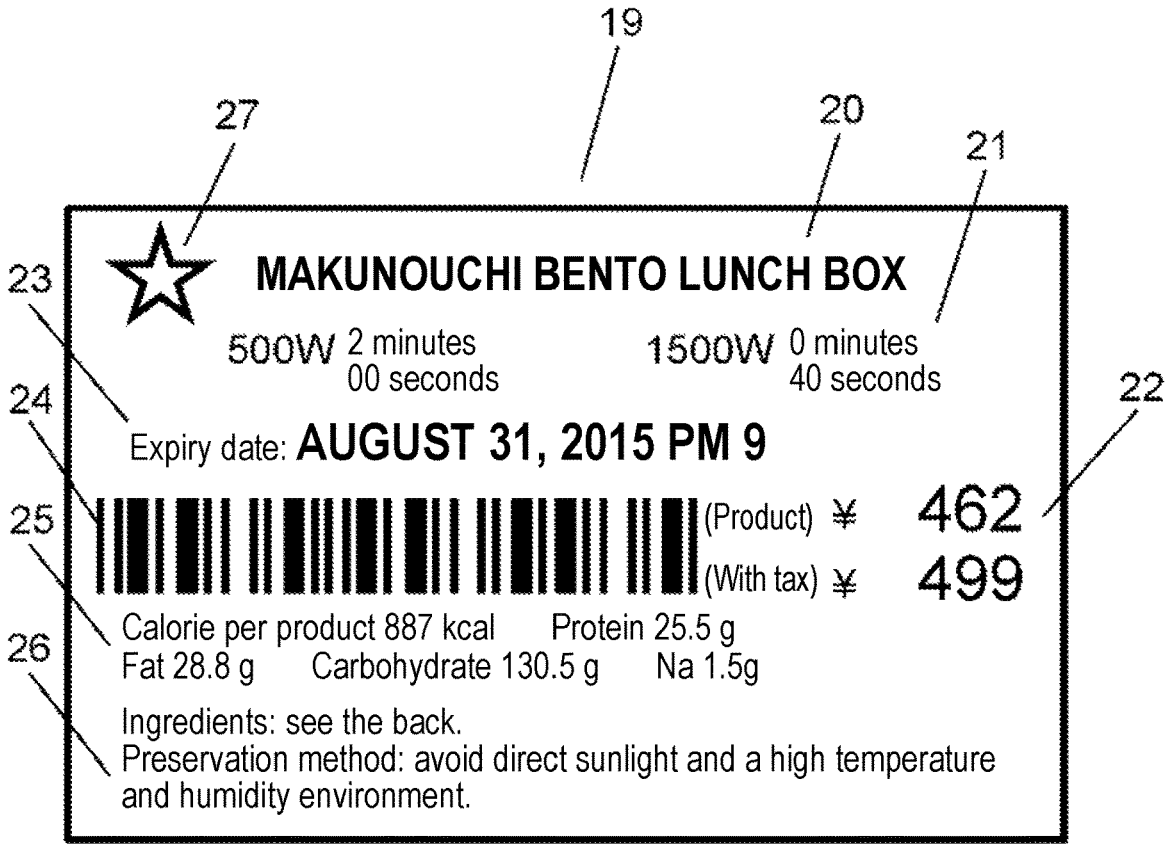
FIG. 3 is a view illustrating a first sticker applied onto a product to be heated with the microwave oven according to the first exemplary embodiment of the present disclosure.

FIG. 3 is a view illustrating first sticker 19 applied onto a product to be heated with microwave oven 1 according to the first exemplary embodiment of the present disclosure. First sticker 19 indicates product name 20, heating control information 21, price information 22, expiry date information 23, bar-code 24 representing an example of a code symbol identifying the product, nutrition information 25, and notification information 26, for example. First sticker 19 indicates first mark 27. First mark 27 being indicated means that the product is a shop's own product. Otherwise, first mark 27 being indicated means that heating control information 21 on first sticker 19 is information confirmed through tests, for example, and that the shop is responsible for the information. In other words, the product can be appropriately heated by following heating control information 21.

First mark 27 and heating control information 21 have a predetermined positional relationship, and are printed on first sticker 19. First mark 27 may be a specific diagram, such as a star shape, a trade name of a manufacturer, an emblem of the manufacturer, a trade name of a shop, an emblem of the shop, or a design combined with the aforementioned items (e.g., logo).

Heating control information 21 indicated on first sticker 19 includes a guide heating period when an ordinary household microwave oven having a heating power value of 500 W is used for heating, for example, and a guide heating period when a commercial microwave oven having greater heating power, such as a heating power value of 1500 W, is used for heating in a shorter period of time, for example. Specifically, an example indication reads "500 W 2 minutes 00 seconds 1500 W 0 minutes 40 seconds".

More specifically, heating control information 21 is a character string including, in order, a first character string that is a numerical character string representing a heating amount with predetermined heating power, such as "500", a second character string representing a unit of the heating power, such as "W", a third character string that is a numerical character string representing a heating period with the heating power, such as "2", a fourth character string representing a unit of the heating period, such as "minute (s)", a fifth character string that is a numerical character string representing a heating period with the heating power, such as "00", and a sixth character string representing a unit of the heating period, such as "second(s)". Heating control information 21 is also a character string including, in order, a seventh character string that is a numerical character string representing a heating amount with greater heating power than the predetermined heating power, described above, such as "1500", an eighth character string representing a unit of the heating power, such as "W", a ninth character string that is a numerical character string representing a heating period with the heating power, such as "0", a tenth character string representing a unit of the heating period, such as "minute(s)", an eleventh character string that is a numerical character string representing a heating period with the heating power, such as "40", and a twelfth character string representing a unit of the heating period, such as "second (s)".

In the present exemplary embodiment, the second character string and the eighth character string use one of the International Systems of Units (SI units), i.e., "Watt (W)" representing a heat capacity. However, another character or a unit may be used as long as the other character or the unit represents a unit of heating power. The fourth character string, the sixth character string, the tenth character string, and the twelfth character string use "minute(s)" and "second (s)" as characters representing a unit of time. However, another character or a unit may be used as long as the other character or the unit represents a unit of time.

Now back to FIG. 2 and continue the description. Mark detector 28 detects a specific mark from an image captured by camera 16. Mark detector 28 includes first mark detector 29 configured to detect first mark 27, and second mark detector 30 configured to detect second mark 31, described later.

First mark detector 29 detects first mark 27 illustrated in FIG. 3. Upon detection of first mark 27 by first mark detector 29, heating controller 14 allows heating by magnetron 13.

Figure 4:
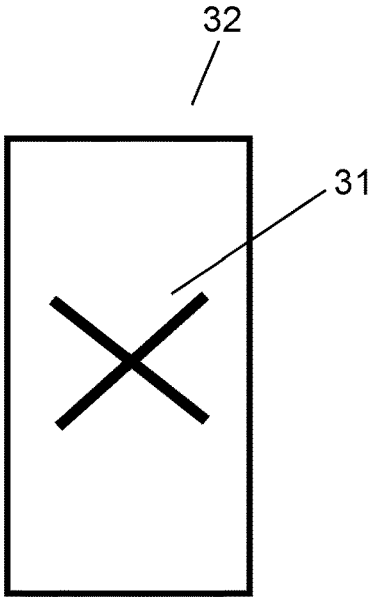
FIG. 4 is a view illustrating a second sticker printed with a second mark and applied onto an accompanied product to be heated with the microwave oven according to the first exemplary embodiment of the present disclosure.

FIG. 4 is a view illustrating second sticker 32 printed with second mark 31 and applied onto an accompanied product to be heated with microwave oven 1 according to the first exemplary embodiment of the present disclosure. Second sticker 32 is a sticker applied onto an accompanied product of a product such as a bento lunch box or a daily dish. The accompanied product is inappropriate for heating with microwave oven 1. The accompanied product may be a seasoning, such as sauce or mayonnaise, contained in a bag.

Second mark 31 is a different diagram from a diagram of first mark 27. Second mark 31 being applied means that the accompanied product is inappropriate for heating with microwave oven 1. Second mark 31 may be a specific diagram, such as a "x" mark, a trade name of a manufacturer of the accompanied product, an emblem of the manufacturer of the accompanied product, or a design combined with the aforementioned items (e.g., logo).

Second mark detector 30 is configured to detect second mark 31 illustrated in FIG. 4. Upon detection of second mark 31 by second mark detector 30, heating controller 14 disallows heating by magnetron 13. Liquid crystal display 7 displays a message warning a consumer that an accompanied product inappropriate for heating is present in heating chamber 12. Such a warning message may be, for example, "A non-heatable product is present." or "Remove the seasoning from the product."

Reader 33 is configured to extract the heating control information applied onto the product from the image captured by camera 16, and reads characters (including at least a numerical character) of the heating control information.

First mark detector 29 first detects first mark 27 from the image captured by camera 16. Next, reader 33 reads, from first mark 27, alphanumeric characters having the predetermined relative positional relationship as a character string of "500W2001500W040". Reader 33 does not read characters representing a unit of time, such as "minute(s)" and "second (s)", or, if read, does not use the characters for analysis.

Reader 33 follows a predetermined analysis rule, separates the character string into four pieces as a numeric string in front of "W", a three-digit numeric string behind "W", a numeric string in front of "W" following the three-digit numeric string, and, a three-digit numeric string behind "W", i.e., "500", "200", "1500", "040", and reads the separated pieces. In the second numeric string and the fourth numeric string among the four numeric strings, respectively, reader 33 regards, for analysis, a first one digit as "minute (s)", and remaining two digits as "second(s)". Reader 33 regards, for analysis, the first numeric string as heating power, and the second numeric string as a corresponding time. Reader 33 regards, for analysis, the third numeric string as heating power, and the fourth numeric string as a corresponding time. As a result, reader 33 reads the heating control information as "500 W for two minutes" and "1500 W for 40 seconds".

Now back to FIG. 2 again to continue the description. The user opens door 3, and puts a product in heating chamber 12. When first mark detector 29 detects that the door is open through door switch 17, first mark detector 29 detects first mark 27 from an image inside heating chamber 12 captured by camera 16. Next, reader 33 reads, from first mark 27, heating control information 21 having the predetermined relative positional relationship.

Reader 33 sends heating control information 21 being read to operation display 6 and heating controller 14. Operation display 6 causes liquid crystal display 7 to display heating control information 21 being received. Heating control information 21 includes two combinations of heating power and heating periods corresponding to the heating power. Reader 33 is supposed to heat a product with the greater heating power within a heatable range in microwave oven 1, and thus sends the heating power and the corresponding heating period to operation display 6 and heating controller 14.

The user confirms that an appropriate heating period is displayed on liquid crystal display 7, closes door 3, and presses heating start button 9. When reception of a signal indicating that door 3 is closed from door switch 17 and a signal indicating that heating start button 9 is pressed from operation display 6, heating controller 14 performs a heating control on magnetron 13 to heat the product with the heating power for the heating period based on heating control information 21 received from reader 33.

In FIG. 2, a microcomputer (not shown) equipped with a central processing unit (CPU), a non-volatile memory, and a volatile memory, for example, configures heating controller 14, reader 33, mark detector 28, first mark detector 29, and second mark detector 30.

Next, how microwave oven 1 according to the present exemplary embodiment operates will now be described.

Figure 5:
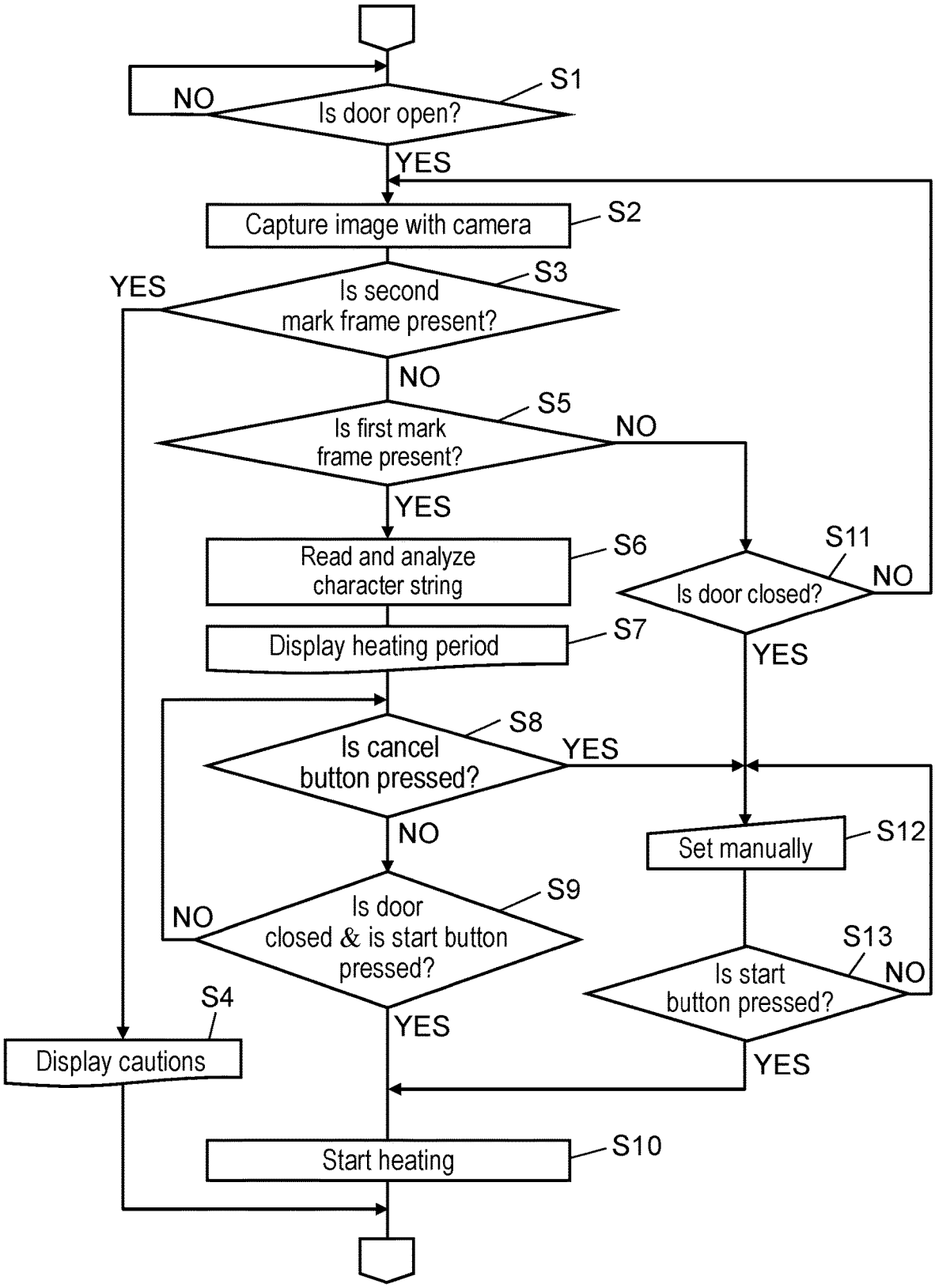
FIG. 5 is a flowchart illustrating an operation flow of the microwave oven according to the first exemplary embodiment of the present disclosure.

FIG. 5 is a flowchart illustrating an operation flow of microwave oven 1 according to the first exemplary embodiment of the present disclosure.

First, in step S1, mark detector 28 or reader 33 determines whether door 3 is open or closed based on a state of door switch 17. When door 3 is open (YES in step S1), the flow proceeds to step S2. On the other hand, when door 3 is closed (NO in step S1), mark detector 28 repeats step S1 and waits until door 3 is open.

In step S2, mark detector 28 or reader 33 causes camera 16 to capture an image of a bottom of heating chamber 12. After that, the flow proceeds to step S3.

In step S3, second mark detector 30 of mark detector 28 looks for second mark 31 in the image. When second mark 31 is found (YES in step S3), the flow proceeds to step S4. On the other hand, when second mark 31 is not found (NO in step S3), the flow proceeds to step S5.

In step S4, second mark detector 30 causes liquid crystal display 7 to display a warning message, such as "A non-heatable product is present". Heating controller 14 does not cause magnetron 13 to perform heating. The flow ends.

In step S5, first mark detector 29 of mark detector 28 looks for first mark 27 in the image. When first mark 27 is found (YES in step S5), the flow proceeds to step S6. On the other hand, when first mark 27 is not found (NO in step S5), the flow proceeds to step S11.

In step S6, reader 33 reads, from first mark 27, alphanumeric characters at a predetermined relative position. In the example sticker illustrated in FIG. 3, reader 33 reads a character string of "500W2001500W040" disposed diagonally right downward from first mark 27. Reader 33 follows the predetermined analysis rule, and regards, for analysis, the character string as heating control information including two combinations as "500 W for two minutes" and "1500 W for 40 seconds". For example, when microwave oven 1 can perform heating with 1500 W, reader 33 selects the greater heating power, i.e., 1500 W. In other words, heating under "1500 W for 40 seconds" is determined. The flow proceeds to step S7.

In step S7, reader 33 sends, to heating controller 14, the heating control information analyzed as described above, i.e., "1500 W for 40 seconds". Liquid crystal display 7 of operation display 6 displays "40 seconds".

In step S8, heating controller 14 determines whether the user has pressed cancel button 10. When cancel button 10 is not pressed (NO in step S8), the flow proceeds to step S9. When cancel button 10 is pressed (YES in step S8), the flow proceeds to step S12.

In the process, when the user confirms a heating period displayed on liquid crystal display 7, and the user determines that the heating period being displayed is wrong, or the user intends to perform heating with another heating period, cancel button 10 being pressed by the user is detected, and heating is performed for another heating period than the heating period displayed on liquid crystal display 7.

In step S9, heating controller 14 determines whether door 3 is closed through door switch 17, as well as determines whether heating start button 9 is pressed. When heating start button 9 is pressed (YES in step S9), the flow proceeds to step S10. Accordingly, heating starts. On the other hand, when heating start button 9 is not pressed, or when the door is not closed (NO in step S9), the flow returns to step S8. Accordingly, a determination of whether cancel button 10 is pressed is repeated.

In step S5, when first mark 27 is not found (NO in step S5), the flow proceeds to step S11. In step S11, mark detector 28 or reader 33 determines whether door 3 is closed through door switch 17. When door 3 is closed (YES in step S11), the flow proceeds to step S12. On the other hand, when door 3 is not closed (NO in step S11), the flow returns to step S2. Accordingly, capturing an image with camera 16 is repeated.

Within a period from when the user opens door 3 to when the user puts a product in heating chamber 12, a loop is normally repeated. In the loop, the flow returns from step S11 to step S2, and proceeds to step 11.

In step S8, when cancel button 10 is pressed (YES in step S8), and, in step S11, when door 3 is closed (YES in step S11), the flow proceeds to step S12. In step S12, heating controller 14 receives a heating period manually set by the user. In the process, when a product without being provided with first mark 27 is heated, or when first mark 27 is dirty and first mark detector 29 cannot read first mark 27, the user can use time setting button group 8 to manually set a heating period.

In step S13, heating controller 14 determines whether heating start button 9 is pressed. When heating start button 9 is pressed (YES in step S13), the flow proceeds to step S10. Accordingly, heating starts. On the other hand, when heating start button 9 is not pressed (NO in step S13), the flow returns to step S12. Receiving a user's manual setting operation by heating controller 14 is repeated.

As described above, with the present exemplary embodiment, when first mark detector 29 detects first mark 27, reader 33 reads, from first mark 27, heating control information having the predetermined positional relationship. The heating control information can thus be easily found and read. For a product without being applied with first mark 27, such as another product than a shop's own product, reader 33 does not read heating control information, and automatic heating does not take place.

Second mark 31 is applied onto an accompanied product inappropriate for heating with microwave oven 1, such as a seasoning contained in a bag. When a user has failed to remove second mark 31 from a product, but puts the product in heating chamber 12, second mark detector 30 detects second mark 31, and heating does not take place. Liquid crystal display 7 displays a warning. Microwave oven 1 does not heat the product with the accompanied product inappropriate for heating being left behind in the product.

In the present exemplary embodiment, a case when two combinations of heating power and heating periods are indicated on first sticker 19 has been described. However, at least one combination of heating power and a heating period corresponding to the heating power may be indicated.

First mark 27 has been described based on an example, i.e., a logo of a manufacturer. However, the present disclosure is not limited to the example. Instead of a logo of a manufacturer, for example, first mark 27 may be a frame surrounding heating control information 21, or a line (underline) below heating control information 21. When first mark 27 is a frame or a line, first mark 27 can be disposed further closer to heating control information 21, further clarifying the predetermined positional relationship with heating control information 21.

First mark 27 has been described based on an example, i.e., a mark printed on first sticker 19. However, first mark 27 may be directly indicated on a product or a wrapping of the product. Similarly, second mark 31 has been described based on an example, i.e., a mark printed on second sticker 32. However, second mark 31 may be directly indicated on an accompanied product to a product or a wrapping of the accompanied product. Second sticker 32 may be adhesive tape used to attach an accompanied product to a product.

Reader 33 has been described based on an example, i.e., reader 33 reads heating control information indicated in a character string. However, the present disclosure is not limited to the example. Reader 33 may read coded information, such as a barcode.

In the example described above, liquid crystal display 7 has been used as the notification unit. When second mark detector 30 has failed to find second mark 31, liquid crystal display 7 displays a warning message. However, the present disclosure is not limited to the example. For example, a light emitting unit, such as a light emitting diode (LED), may be provided as a notification unit. The light emitting unit may blink as required. A sound output unit, such as a buzzer or a speaker, may be provided as a notification unit. The sound output unit may be caused to output a sound or to sound a caution message.

As described above, a cooker corresponding to microwave oven 1 according to the present exemplary embodiment includes heating chamber 12 configured to accommodate an object to be heated, a heater corresponding to magnetron 13 configured to heat the object to be heated accommodated in heating chamber 12, heating controller 14 configured to control the heater for heating, an image capturing unit corresponding to camera 16 configured to capture an image inside heating chamber 12, and mark detector 28 configured to detect a specific mark from the image captured by the image capturing unit. Heating controller 14 disallows or allows heating by the heater based on a result of detection by mark detector 28.

With this configuration, the image capturing unit captures an image inside the heating chamber accommodating the object to be heated. Mark detector 28 detects a specific mark from the image captured by the image capturing unit. Heating controller 14 configured to control the heater disallows or allows heating by the heater, based on a result of detection by mark detector 28. Therefore, by applying a specific mark allowing heating onto only a certain product having undergone tests, for example, or by applying a mark disallowing heating onto an accompanied product inappropriate for heating with a microwave oven, only the certain product can be allowed to be heated, as well as the accompanied product inappropriate for heating with microwave oven 1 can be prevented from being heated.

The cooker corresponding to microwave oven 1 may further include reader 33 configured to read heating control information 21 applied onto an object to be heated. When mark detector 28 detects first mark 27, reader 33 reads, from an image captured by the image capturing unit, heating control information 21 having the predetermined positional relationship with first mark 27. Heating controller 14 controls the heater, based on heating control information 21 read by reader 33. When mark detector 28 does not detect first mark 27, the reader does not read heating control information 21.

With this configuration, reader 33 recognizes heating control information 21 having the predetermined positional relationship from first mark 27. Heating controller 14 controls the heater, based on heating control information 21. Therefore, by specifying a positional relationship beforehand between first mark 27 and heating control information 21, heating control information can be easily found and read. By applying first mark 27 onto only shop's own products having undergone tests, for example, heating control information on a product that the shop does not have responsibility, such as another product than the shop's own products, is not to be read.

The cooker corresponding to microwave oven 1 may further include a notification unit corresponding to liquid crystal display 7 configured to provide notifications. When mark detector 28 does not detect second mark 32, heating controller 14 allows heating by the heater. When mark detector 28 detects second mark 32, the notification unit provides a notification.

With this configuration, by applying second mark 31 onto an accompanied product inappropriate for heating with microwave oven 1, such as a seasoning contained in a bag, even when a user has failed to remove the seasoning contained in the bag, for example, from a product, but puts the product in heating chamber 12, mark detector 28 detects second mark 31, and the notification unit provides a warning. Therefore, heating of the product with the accompanied product inappropriate for heating with the microwave oven being left behind can be prevented.

INDUSTRIAL APPLICABILITY

As described above, with the present disclosure, the image capturing unit captures an image inside the heating chamber accommodating a food product. The mark detector detects a specific mark from the image captured by the image capturing unit. The heating controller configured to control the heater disallows or allows heating by the heater based on a result of detection by the mark detector. Therefore, only certain products having undergone tests, for example, and applied with a mark allowing heating can be allowed to be heated. Otherwise, accompanied products that are inappropriate for heating with a microwave oven and that are applied with a mark disallowing heating can be prevented from being heated erroneously. The present disclosure can be applied to general cookers including commercial microwave ovens used in shops handling food products, other rice cookers, and induction and heating (IH) cooking heaters.

The invention claimed is:

1. A cooker comprising:

a heating chamber configured to accommodate an object to be heated;

a heater configured to heat the object to be heated accommodated in the heating chamber;

a heating controller configured to control the heater for heating;

a camera configured to capture an image of the object and a first mark and a second mark that may be applied onto the object inside the heating chamber; and a mark detector configured to detect the first mark and the second mark from the image captured by the camera, wherein the first mark represents that the object can be heated, and the second mark represents that the object is inappropriate for heating, and wherein at least one of the first mark and the second mark is applied onto the object, wherein, in response to detection of only the first mark by the mark detector, the heating controller allows heating of the object by the heater, and in response to detection of the second mark by the mark detector, the heating controller disallows heating of the object by the heater and provides a notification.

2. The cooker according to claim 1, further comprising a reader configured to read heating control information applied onto the object to be heated, wherein, when the mark detector detects the first mark, the reader reads the heating control information having a predetermined positional relationship with the first mark from the image captured by camera, and the heating controller controls the heater based on the heating control information read by the reader, and wherein, when the mark detector does not detect the first mark, the reader does not read the heating control information.

3. The cooker according to claim 1 or 2, further comprising at least one of a liquid crystal display, a light emitting diode, a buzzer and a speaker configured to provide the notification, wherein, when the mark detector does not detect the second mark, the heating controller allows heating by the heater, and wherein, when the mark detector detects the second mark, the at least one of the liquid crystal display, the light emitting diode, the buzzer and the speaker provides the notification.

* * * * *